US005239163A

United States Patent [19]

Brouwers

[11] Patent Number: 5,239,163

[45] Date of Patent: Aug. 24, 1993

[54] AUTOMOBILE AIR HEATER UTILIZING PTC TABLETS ADHESIVELY FIXED TO TUBULAR HEAT SINKS

[75] Inventor: Arnoldus M. Brouwers, Wierden, Netherlands

[73] Assignee: Texas Instruments Incorporated, Dallas, Tex.

[21] Appl. No.: 717,561

[22] Filed: Jun. 19, 1991

[51] Int. Cl.[5] ..... H05B 1/02; F24H 3/04; H01C 7/02

[52] U.S. Cl. ..... 219/202; 165/80.3; 165/185; 219/505; 219/530; 219/540; 338/22 R; 392/360; 392/365; 392/379

[58] Field of Search ..... 219/202, 505, 530, 540; 165/185, 80.3; 392/347-378, 379-385; 338/22 R

[56] References Cited

U.S. PATENT DOCUMENTS

| | | | |
|---|---|---|---|
| 3,212,275 | 10/1965 | Tillman | 165/80.3 |
| 3,852,567 | 12/1974 | Michaud et al. . | |
| 4,346,285 | 8/1982 | Nakamura | 219/505 X |
| 4,414,052 | 11/1983 | Habata et al. | 219/540 X |
| 4,703,153 | 10/1987 | Pelonis | 392/505 X |
| 4,963,716 | 10/1990 | Van Den Elst et al. | 219/202 |
| 5,057,672 | 10/1991 | Bohlender et al. | 219/540 |

FOREIGN PATENT DOCUMENTS

| | | | |
|---|---|---|---|
| 243077 | 10/1987 | European Pat. Off. | 219/202 |
| 350528 | 1/1990 | European Pat. Off. . | |
| 2404985 | 4/1979 | France . | |
| 54-19233 | 2/1979 | Japan | 219/505 |
| 58-86346 | 5/1983 | Japan | 392/379 |
| 2167905 | 6/1986 | United Kingdom | 165/185 |

*Primary Examiner*—Anthony Bartis

*Attorney, Agent, or Firm*—Russell E. Baumann; Richard L. Donaldson; René E. Grossman

[57] ABSTRACT

An electric heater for air supplied to the passenger compartment of an automobile has a plurality of extruded tubular metal members in side-by-side spaced parallel relationship within an open electrically insulative frame. Each tubular member has a pair of spaced heat sinks with a plurality of spaced lamenallae extending therebetween to form air flow passages. A plurality of PTC heating tablets are positioned in the space between the opposed outer surfaces of the heat sinks of adjacent tubular members, with one face of each PTC tablet fixed to one heat sink by a rigid electrically conductive adhesive and the other face thereof is fixed to the adjacent heat sink by a flexible electrically conductive adhesive. The heat sinks have integral platforms on which the PTC tablets are positioned with the edges of the tablets projecting beyond the edges of the respective platforms. The tubular members of each adjacent pair of tubular members are connected to respective ones of a pair of voltage rails in the frame through a fuse.

8 Claims, 2 Drawing Sheets

AUTOMOBILE AIR HEATER UTILIZING PTC TABLETS ADHESIVELY FIXED TO TUBULAR HEAT SINKS

BACKGROUND OF THE INVENTION

The invention relates to an air heater comprising a number of parallel strip-shaped sheet metal heat sinks mounted in a frame, a number of PTC tablets, a large number of heat-conducting lamellae extending transversely to the heat sinks and electrical connection means.

A similar air heater is known from EP-A-0,350,528 (David & Baader).

The device can be used on automobiles to heat ventilation air supplied to the windshield, before the motor is warm enough to take over the air heating through the normal heating radiator. One advantage is that cold air can be heated electrically without any advanced regulator mechanism, and the temperature cannot rise above a level dictated by the properties of the PTC material.

In the known device the heat sinks consist of separate metal strips and the lamellae are always attached to the heat sinks by soldering. The PTC tablets lie flat against the heat sinks without being glued to them. This presents a risk of corrosion at the contact surfaces between PTC tablets and heat sinks, leading to a bad electrical contact. Two of the four frame sides or borders consist of two mutually displaceble lengths, between which an undulating spring belt is placed, which presses the inner length onto an adjacent metal heat sink strip and thus clamps the entire package of separate heat sinks, lamellae and loose PTC tablets inside the frame. In addition, the PTC tablets are kept in place by an extra plastic holder. The production, separately, of heat sink strips and lamellae, the soldering of the films and the assembly into a unit, leads to an expensive construction. Then, in order to have a good contact between the PTC tablets and the heat sinks, they have to be precisely placed flat on one another; the tolerances are small, and this also increases the cost.

BRIEF SUMMARY OF THE INVENTION

An object of the present invention is to eliminate these drawbacks and with this in mind the air heater cited above is characterized by the application of tubular members extruded from aluminum or an aluminum alloy, each with two heat sinks and lamellae extending between them, the PTC tablets being fixed to the heat sinks by a current-conducting adhesive. In so doing, corrosion on the electrical contact surface between heat sinks and pills is prevented.

In order to prevent leakage of the current-conducting adhesive with which the PTC tablets are attached to the heat sinks, which leakage could lead to short-circuiting, the heat sinks are extruded with elevated platforms for placement of the PTC tablets and the PTC tablets project with their outer perimeter on all sides beyond the peripheral edges of the elevated platforms. The excess adhesive runs off into the space between the projecting edges of the PTC tablets and the related heat sink.

Short-circuiting by other causes can be prevented by coating the tubular members with a heat-resistant, electrically non-conductive covering. To prevent the PTC tablets from coming loose owing to unequal temperature expansion, one of the heat sinks of each cylindrical profile is provided with an expansion gap produced in the extrusion whereby each PTC pill is attached on one surface by a hard adhesive and at the other surface by a soft adhesive.

In order to interrupt the current locally, in the event of a short-circuit, without shutting down the entire heater, a thickened wall portion or boss of each tubular member has an opening formed in the extrusion, and in this opening a fuse holder in the form of a small stainless steel tube is forced, forming a dependable electrical contact with the aluminum by exclusion of oxygen. The small tubes are connected, in the position of successive tubular members, alternately through a fuse and a fine contact spring with the one current rail, and through a small contact spring with the other current rail. All subassemblies of tubular members and small tubes are identical, therefore inexpensive.

The device can easily be put together by clamping together upper and lower portions of the frame around their perimeter locking therein the plurality of tubular members and PTC tablets. A spring is placed between the frame and the tubular members to allow for thermal expansion and contraction of the parts. The frame provides thermal and electrical insulation.

The air heater according to the invention is eminently suitable for attachment to the housing of a standard automobile cooling water radiator.

Note that EP-A-0,243,077 (Ford Motor Company) describes an electric air heater disposed in the ventilation duct of an automobile, which comprises a housing made of insulating material in which two sets of heat-conducting plates are mounted, an undulating fin strip is disposed between the plates in each strip, and PTC tablets are placed between the facing plates of the two sets. In this construction again, the fin strips are soldered to the heat-conducting plates adding considerably to the expense of the heater as well as presenting reliability problems. One advantage of this heater not provided by extrusion is, of course, that the fins can be louvered to improve the heat transfer to the air. In the device made in accordance with the invention, the heat transfer to the air can be increased by placing the lamellae closer together and/or extending the airflow path inside the heater.

Furthermore, from DE-A-3,119,302, a number of models of an air heater are shown, in which PTC material is disposed between two heat sinks formed as separate flat strips and to the heat sinks are connected lamellae in the form of shell-cast elements or elements corrugated from a plate made, for example, of aluminum. Extrusion is mentioned only in connection with the PTC element. The use of extruded cylindrical profiles encompassing both two heat sinks and lamellae extending between them is not suggested in the publication.

The invention will now be described in more detail with the aid of the figures.

DESCRIPTION OF THE PREFERRED EMBODIMENT

Figure 1:
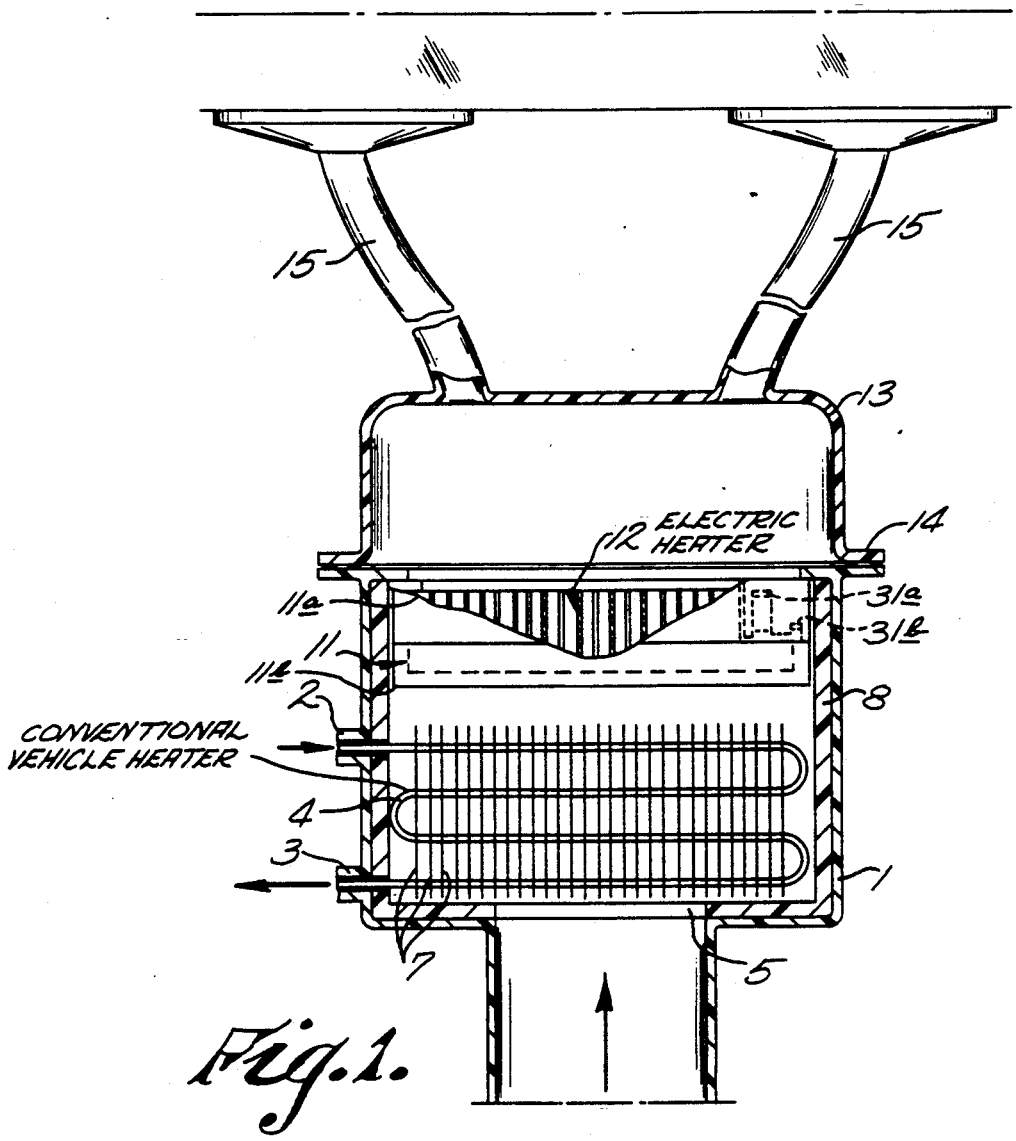
FIG. 1 shows a schematic sectional representation of a heating radiator of an automobile with an electric air heating device according to the invention connected to it.

The conventional radiator of an automobile as sketched in FIG. 1 comprises a housing 1 with coolant inlet 2 and coolant outlet 3, a coolant tube 4 extending between this inlet and outlet, and an air inlet opening 5. Heat exchange strips 7. The coolant in tube 4 is heated by automobile engine during start-up operation are attached to tube 4 and extend in the direction of flow of the air indicated by an arrow. Thermal insulation material 8 is disposed on the inner surface of the housing 1. Inside the housing 1 a frame 11 is mounted downstream of the tube 4, and inside this frame there is an electric heater 12 to be described in more detail. On housing 1 a distributor chest 13 is mounted by means of a flange connection 14. From this distributor chest there extend air hoses 15 toward the interior of the auto.

Figure 2:
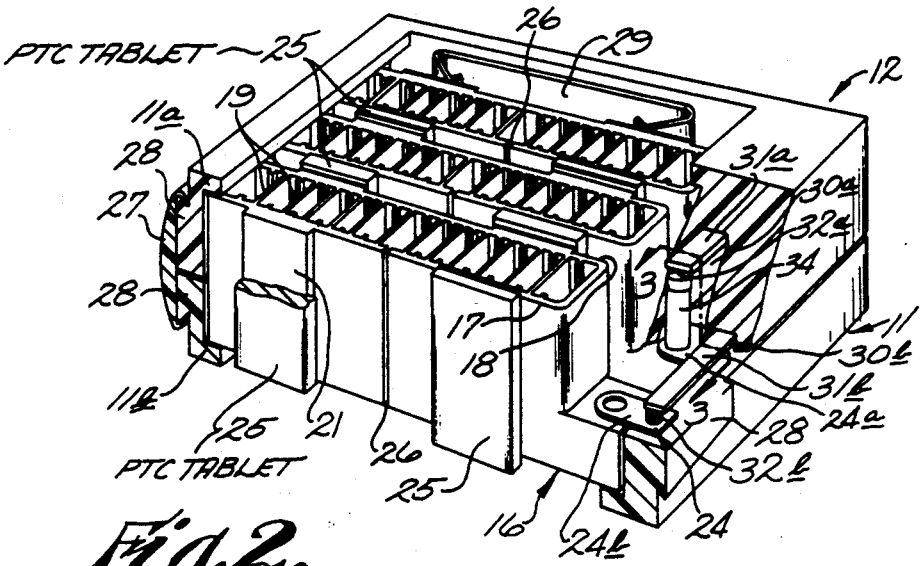
FIG. 2 is a perspective view of a part of the electric air heater according to FIG. 1.
Figure 3:
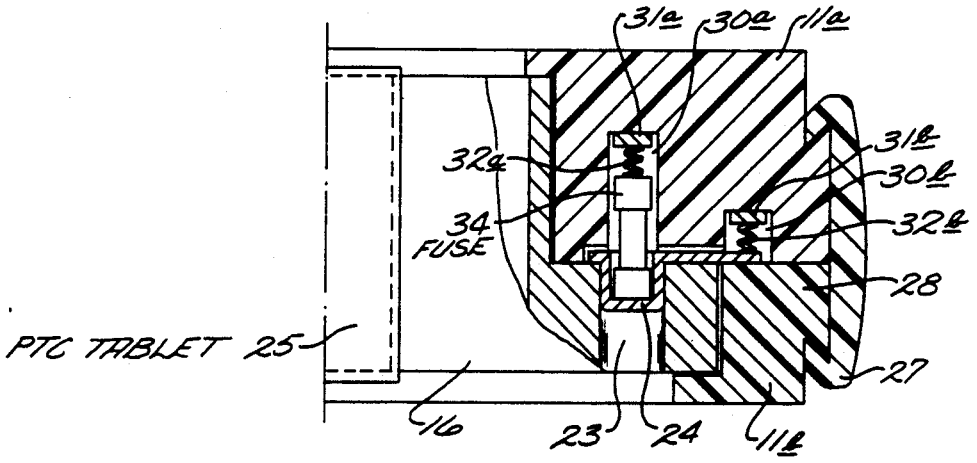
FIG. 3 is a section view cut along line 3—3 of FIG. 2.
Figure 4:
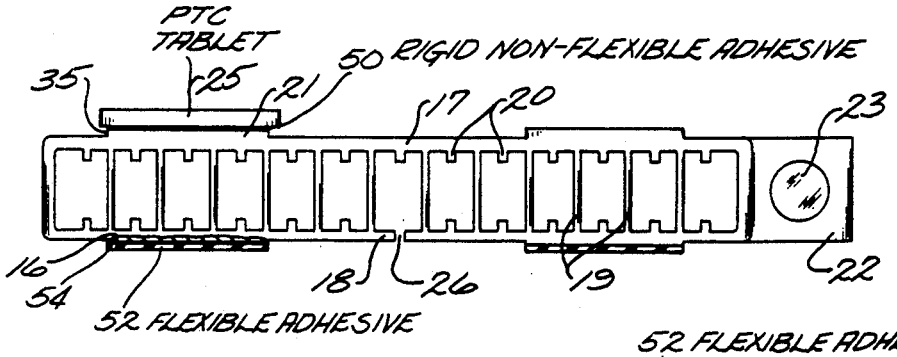
FIG. 4 shows a tubular profile to be used in the assembly of the electrical air heater according to FIG. 2.
Figure 4A:
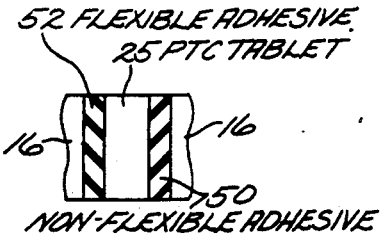
FIG. 4*a* shows an elarged view of tubular members with a PTC tablet therebetween.

FIGS. 2 to 4 show the construction of the electric heater 12.

Inside the frame 11 a number of tubular members 16 are mounted. These are made by extrusion of aluminum or an aluminum alloy and encompass two heat sinks 17, 18 and lamellae 19 extending between these heat sinks and shorter lamellae 20 intermediate respective lamellae 19. Elevated platforms 21 are formed by extrusion on the heat sinks. One side of the tubular member 16, over a part of the height, is provided with a thickened wall or boss 22 in which a bore 23 is cut. In this bore a small stainless steel tube 24 is forced, which serves as a fuse holder and provides a dependable contact between aluminum and stainless steel.

Tablets 25 made of a material with positive temperature coefficient (PTC), are fixed on the elevated platforms 21 by a heat and current-conducting adhesive (for example an epoxy adhesive filled with silver particles).

One of the heat sinks 18 of each tubular member is provided with an expansion gap 26 formed during the extrusion.

As shown in FIG. 2, the tubular members 16 are separated from one another by the PTC tablets 25 positioned between the opposed platforms 21 of the respective members 16.

Each PTC tablet is adhered with its two surfaces to an elevated platform 21, specifically to an elevated platform of one tubular member 16 by means of a flexible, rubber-like adhesive 52 as is known in the art, and to an elevated platform of another tubular member 16 by means of a rigid adhesive 50 as is known in the art. In so doing, the tablets will not come loose due to heat expansions and contractions. The expansion gap 26 in each tubular member makes this expansion and contraction movement possible.

An elastic leaf spring 29 confines the packet of cylindrical profiles and PTC tablets in the frame 11 and takes up heat expansion between the stack of heat sinks and the frame.

Frame 11 comprises an upper portion 11*a* and a lower portion 11*b* clamped to each other around the circumference of the frame by a clamp 27 as best seen in FIG. 3. In frame portion 11*a* two channels, 30*a* and 30*b* respectively, are formed, and in each of these channels a current rail 31*a*, 31*b* respectively is disposed. The current rail 31*a* is connected to alternate tubular members 16 through a contact spring 32, a fuse 34, the bottom of the related forced-in tube 24 and thus with the related tubular member 16. The current rail 31*b* is connected through contact spring 32 and tube 24 with the other tubular members 16.

If current rail 31*a* is electrically positive and current rail 31*b* electrically negative, an electric current will be produced through rail 31*a*, fuses 34, and tubes/fuse holders 24 to the related tubular members and from there through, the PTC tablets 25, the other tubular members, the tubes/fuse holders 24 associated with channel 30*b* (without fuses) to rail 31*b*. The PTC tablets are heated to a temperature dependent on the material thereof and give off their heat to the tubular members through which the ventilation air flows and is thereby quickly brought to the desired temperature. As soon as the engine is up to temperature, the air will be heated sufficiently in the conventional heater, so that the electric heater can be shut off by a thermostat. Under very cold conditions and in very efficient automobile engines that give off very little heat, the electric heater can be continuously in operation while driving.

Essential to the invention is the use in the electric heater of extruded tubular members with two heat sinks and lamellae between them.

To prevent short-circuiting, the following steps are taken: the tubular members 16 are covered with a heat-resistant, electrically non-conducting coating except where electrical contacting is being made with PTC tablets and the PTC tablets 25 have an outer periphery which on all sides project beyond the circumferential edges of the elevated platforms 21, so that any excess of conductive adhesive can flow into the space 35 between the projecting peripheral edges of the tablets and the related heat sink, and cannot well up and come in contact with the adjacent heat sink.

With the electrical connection described, the tubular members are alternately positive and negative. Other connection sequences are also possible.

The invention is applicable not only to automobiles but also to small electric stoves and the like.

The present invention has been described by way of a preferred form of realization. It will be understood, however, that variations and modifications can be made in the same without departing from the scope of the present invention.

We claim:

1. An air heating device comprising an open electrically non-conductive frame containing two voltage rails, a plurality of extruded metal tubular members disposed in side-by-side parallel spaced relationship within the frame; said plurality of tubular members having a pair of spaced heat sinks having a plurality of spaced lamellae extending therebetween to form a plurality of air flow passages through each tubular member, and a plurality of PTC tablets each having two faces and being positioned in the space between the opposed outer surfaces of each heat sink pairs for adjacent tubular members, with one face being fixed to the outer surface of the heat sink of a tubular member by a rigid adhesive and the other face of the tablet being fixed to the outer surface of the heat sink of an adjacent tubular member by a flexible adhesive wherein one tubular member of each adjacent pair of tubular members is electrically connected to one voltage rail and the other tubular member to the other voltage rail.

2. An air heating device comprising an open electrically non-conductive frame containing two voltage rails, said frame having a portion extending perpendicular to the heat sinks, two channels are hollowed out of said portion, each of the channels being provided with one of the voltage rails, a plurality of extruded metal tubular members disposed in side-by-side parallel spaced relationship within the frame; said plurality of tubular members having a pair of spaced heat sinks having a plurality of spaced lamellae extending therebetween to form a plurality of air flow passages through each tubular member, and a plurality of PTC tablets being positioned in the space between the opposed outer surfaces of said heat sink pairs for adjacent tubular members and being fixed to said opposed heat sinks by an electrically conductive adhesive means wherein one tubular member of each adjacent pair of tubular members is electrically connected to one voltage rail and the other tubular member to the other voltage rail.

3. An air heating device according to claim 2 wherein a bore is provided in a thickness wall portion of each tubular member in which an electrically conductive tube is pressed, said electrically conductive tube of each tubular member electrically connected to said one voltage rail being connected thereto through a fuse and a contact spring, and the electrically conductive tube of each tubular member electrically connected to the other voltage rail being connected thereto through a contact spring.

4. An air heating device according to claim 2, wherein said frame consists of two portions clamped to each other, the clamping plane extending along the circumference of the frame.

5. An air heating device according to claim 2, wherein said plurality of tubular members and the PTC tablets are locked up by a spring within the frame.

6. An air heating device according to claim 2 wherein said tubular members are coated with a heat resistant electrically non-conductive material except where said members are in electrical contact with PTC tablets through the adhesive to minimize any electrical shorting problems.

7. An air heating device according to claim 2 wherein said frame of the air heating device is adapted to be connected to the housing of a radiator containing coolant of an engine of an automobile so that ventilation air flows in succession through the radiator and the heating device.

8. An air heating device comprising an open electrically non-conductive frame containing two voltage rails, a plurality of extruded metal tubular members disposed in side-by-side parallel spaced relationship within the frame; said plurality of tubular members having a pair of spaced heat sinks having a plurality of spaced lamellae extending therebetween to form a plurality of air flow passages through each tubular member, and a plurality of PTC tablets being positioned in the space between the opposed outer surfaces of said heat sink pairs for adjacent tubular members, said heat sinks are provided with integral platforms for positioning and affixing said PTC tablets to said heat sinks, said platforms having circumferential edges such that said PTC tablets circumferential edges project beyond the circumferential edges of the platforms on all sides, wherein one tubular member of each adjacent pair of tubular members is electrically connected to one voltage rail and the other tubular member to the other voltage rail.

* * * * *